United States Patent [19]

Bórk et al.

[11] 4,105,353

[45] Aug. 8, 1978

[54] BARRIER WITH INTERNAL DRAINAGE DUCT

[76] Inventors: C. Gary Bórk, 185 E. Bixby Rd., Long Beach, Calif. 90807; John E. Kenan, 747 Luton Dr., Glendale, Calif. 91206

[21] Appl. No.: 747,817

[22] Filed: Dec. 6, 1976

Related U.S. Application Data

[63] Continuation of Ser. No. 622,079, Oct. 14, 1975, abandoned.

[51] Int. Cl.[2] ..... C01C 11/22

[52] U.S. Cl. ..... 404/2; 404/6

[58] Field of Search ..... 404/2, 3, 4, 5, 6, 7, 404/8; 256/1, 13.1

[56] References Cited

U.S. PATENT DOCUMENTS

| | | | |
|---|---|---|---|
| 355,810 | 1/1887 | Brown | 404/7 |
| 683,305 | 9/1901 | Levin | 404/7 |
| 696,792 | 4/1902 | Bedell | 404/7 |
| 775,791 | 11/1904 | Austin | 404/7 |
| 3,678,815 | 7/1972 | Yonker | 404/6 |
| 3,807,699 | 4/1974 | France | 404/6 |

FOREIGN PATENT DOCUMENTS

| | | | |
|---|---|---|---|
| 1,366,067 | 9/1974 | United Kingdom | 404/2 |

*Primary Examiner*—Henry S. Jaudon
*Attorney, Agent, or Firm*—Roger A. Marrs

[57] ABSTRACT

A barrier section for separating the center of a two-way roadway is disclosed herein including a thickened foot portion embedded in the ground with an integrally formed upstanding rail portion rising vertically above the surface of the ground. The foot portion is provided with an open-ended conduit or duct and passageways are provided at an angle leading from the ground surface to the duct in a downwardly converging arrangement. Both barrier portions include steel rod reinforcement extending longitudinally and transversely with respect to the duct. Interlocking devices are carried on opposite ends of the barrier for mating with and interconnecting with additional adjacent barrier sections.

7 Claims, 6 Drawing Figures

Fig. 1
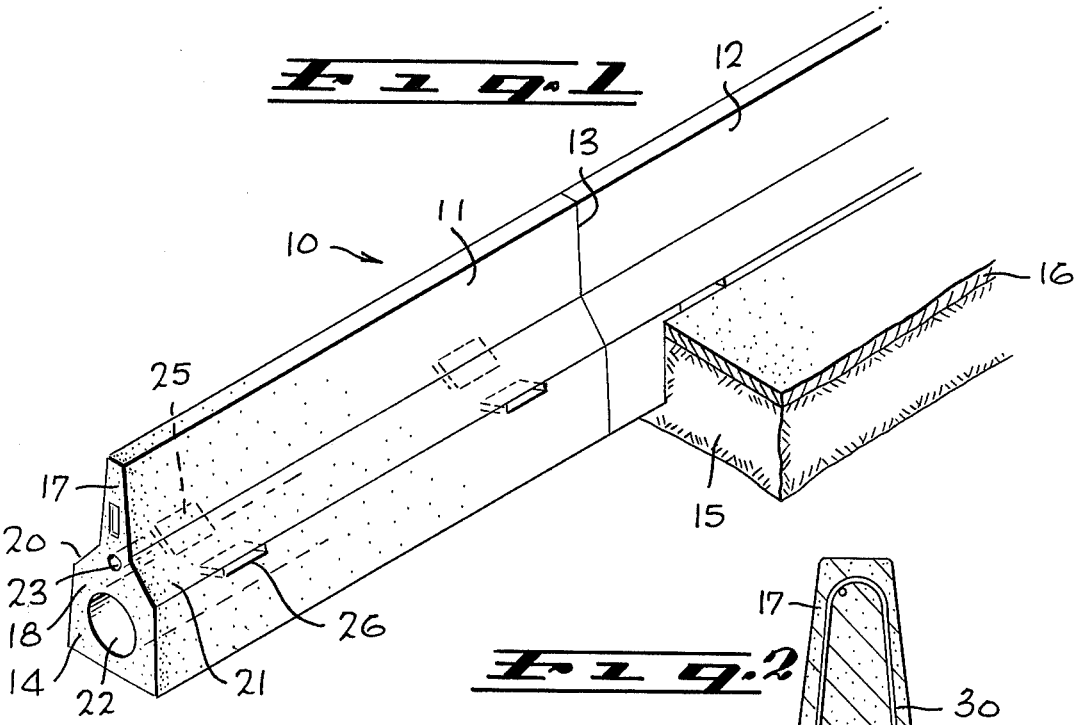
Fig. 2
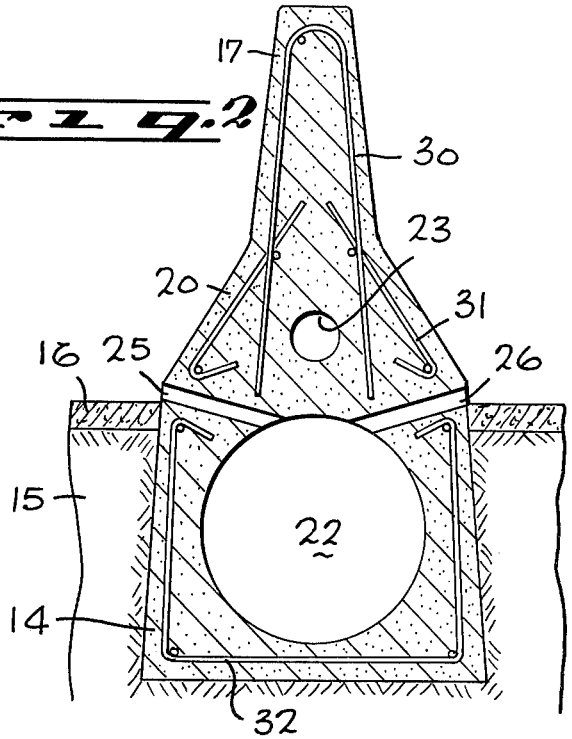
Fig. 3
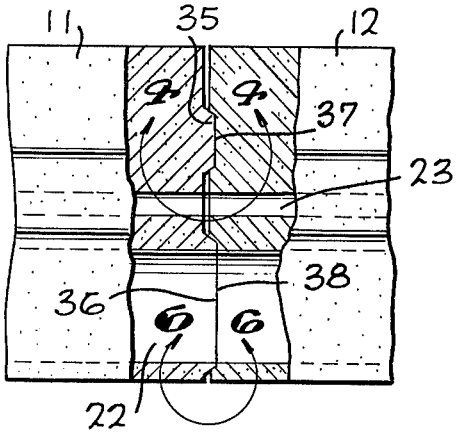
Fig. 5
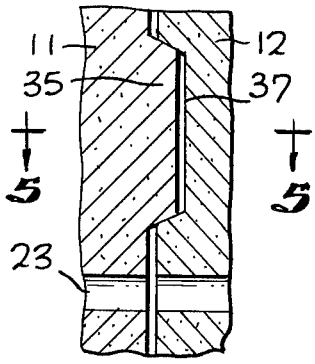
Fig. 4
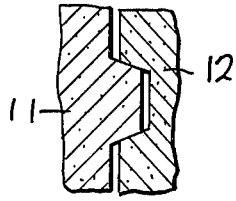
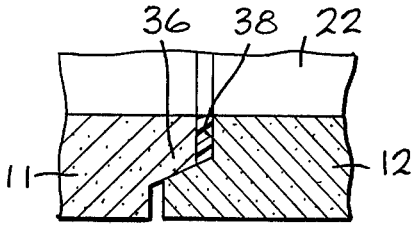
Fig. 6

BARRIER WITH INTERNAL DRAINAGE DUCT

This is a continuation of application Ser. No. 622,079, filed Oct. 14, 1975, now abandoned.

BACKGROUND OF THE INVENTION

1. Field of the Invention

This invention relates to roadway dividers or barriers and more particularly to a barrier section having internal ducts and passageways for conducting drainage and housing cables.

2. Brief Description of the Prior Art

In the past, it has been the conventional practice to employ a barrier or fence for separating the on-coming lanes of a roadway or freeway. The barriers are configured so as to efficiently and adequately prevent automobiles from crossing over the barrier into on-coming traffic. Usually, a barrier comprises a plurality of barrier sections each of which is composed of cement and wherein the sections are placed in an end-to-end relationship so as to form an elongated barrier many miles in length. In some instances, plates or other coupling means are provided for securing the opposing ends of the barrier sections together so that a rigid construction is produced.

Although these conventional barriers have been successful in preventing vehicle crossover from one lane to another, difficulties have been encountered which stem largely from the fact that low spots in the roadway collect water, debris and other foreign matter and such collection provides an undesired hazard to the driver of the vehicle. Conventional practice provides for external drainage systems such as open channels, grooved surfaces and the like for conducting water from the roadway surface. Such practices have not been particularly successful due to the fact that puddles and exposed water does still exist since drainage takes time. Also, conventional barriers are not equipped to carry electrical cabling, pipes or other ancillary equipment.

Therefore, a long standing need has existed to provide a barrier section which includes interconnecting means so that the opposing end of adjacent sections may be guided toward one another and suitably coupled together as well as providing internal drainage, ducts and passageways for conducting water from the surface of the roadway.

SUMMARY OF THE INVENTION

Accordingly, the above problems and difficulties are obviated by the present invention which provides a novel barrier section having internal drainage means comprising an open-ended duct formed in the foot or thickened portion of the barrier section and including a plurality of passageways downwardly extending from the ground surface to the duct so that drainage of the surrounding roadway can be achieved. Furthermore, an additional feature of the invention resides in providing other open-ended ducts for accommodating electrical cable or the like so that no external plubming, cabling, pipes or the like are required for achieving purposes of drainage and cabling. Reinforcement means are provided for increasing the strength of the structure and interlocking guide members are employed at the opposite ends of the barrier sections for intercoupling with the ends of adjacent barrier sections.

Therefore, it is among the primary objects of the present invention to provide a novel barrier section having internal drainage capabilities and which provide for internal mounting of the electrical wiring, cables and other plumbing or conduit assemblies.

Another object of the present invention is to provide a novel roadway barrier section which is internally reinforced and includes a central duct with interconnecting passageways for accommodating drainage of roadway surfaces.

Still a further object of the present invention is to provide a novel roadway barrier section having internal, open-ended ducts and which includes intercoupling means for guiding and aligning the opposite ends of adjacent barrier ends together so that the internal ducts are co-extensive between barrier sections.

A further object of the present invention is to provide a novel roadway barrier section which is economical to manufacture and which eliminates the need for external handling or mounting of electrical cabling and special formation of drainage systems.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

FIG. 1 is a perspective view of the novel barrier section of the present invention illustrating a typical installation;

FIG. 2 is a transverse cross sectional view of the novel barrier section shown in FIG. 1;

FIG. 3 is an enlarged fragmentary view showing the intercoupling means for joining adjacent ends of the barrier sections;

FIG. 4 is a view of the intercoupling means shown in FIG. 3 as taken in the direction of arrows 4—4 thereof;

FIG. 5 is a fragmentary sectional view showing the guide or keying means for guiding the opposite ends of the barrier sections together; and FIG. 6 is a sectional view of the intercoupling means shown in the direction of arrows 6—6 of FIG. 3.

DESCRIPTION OF THE PREFERRED EMBODIMENT

Referring to FIG. 1, the novel barrier section of the present invention is illustrated in the general direction of arrow 10 and is shown as a co-extensive barrier with another identical section. Barrier section 11 is illustrated as being co-extensive with barrier section 12 and the sections are mated at the line 13. Barrier section 11 includes a thickened foot portion 14 which is intended to be buried in the ground 15 on which the roadway pavement 16 is constructed. The barrier section further includes an upstanding portion 17 which is integrally formed with the foot portion 14 and is intended to upwardly project from the surface of the roadway 16. Intermediate the foot portion and the upstanding portion 17, there is provided a tapered intermediate portion identified by the numeral 18. The intermediate portion includes sloping opposite sides identified by numeral 20 and 21 respectively.

It is also to be particularly noted that a plurality of internal passageways and ducts are provided in the barrier section and numeral 22 identifies an open-ended duct which is formed in the foot portion 14 and extends from one end of the barrier section to the other. Also, a smaller diametered passageway or duct 23 is provided which is arranged in fixed parallel relationship with respect to the duct 22. Duct 22 may be employed for carrying water such as in a drainage system and duct 23 may be employed for carrying cabling such as telephone wires or the like. The thickened portion 14 also includes a pair of downwardly converging passageways indicated by numeral 25 and 26 which intercommunicate at one end with duct 22 and exteriorly of the barrier section adjacent the surface of pavement 16. This relationship is more clearly seen in FIG. 2 wherein water may be conducted via passageways 25 and 26 into the main duct 22.

FIG. 2 also illustrates that the three portions of the carrier section include reinforcing rods which rigidize and strengthen the concrete construction of the barrier section. A substantially U-shaped rod 30 is incorporated into the upstanding portion 17 and the intermediate portion 20 while additional transverse and cross sectional rods 31 reinforce the tapered portion 20. The foot portion 14 is reinforced by the transverse and longitudinally extending rod network broadly identified by numeral 32. In this view, it can also be seen that the foot portion 14 is embedded in the ground 15 and that the upstanding portion 17 including intermediate portion 20 project upwardly from the surface of pavement 16.

Referring now to FIGS. 3–6 inclusive, indexing or guide means are illustrated as well as interlocking means for guiding and joining opposing ends of adjacent barrier sections. One end of each barrier such as barrier section 11 includes outwardly projecting elements indicated by numerals 35 and 36 while the opposite end of each barrier section includes shaped depressions 37 and 38 which are intended to correspond to the shape of the element 35 and 36 so that when mated, the opposing surfaces of the barrier sections are flush with each other and proper indexing or registery is received with respect to conduit 22 and conduit 23 of the adjacent barrier sections.

In FIG. 4, element 35 is illustrated as having a tapered projection adapted to be fitted into a reverse tapered depression formed in barrier section 12. Such correspondence in shape operates as a guide or indexing means so that the respetive ends of the barrier sections may be aligned. In a similar fashion, FIG. 6 shows the element 36 configured to guide and index with depression 38 so that the barrier sections 11 and 12 may be placed in register and conduit 22 will be indexed to be co-extensive.

In view of the foregoing, it can be seen that the barrier section 11 of the present invention may be readily joined with the barrier section 12 so that an elongated, co-extensive and continuous fence is provided. By employing the guiding and interlocking elements and depressions, conduits 22 and 23 are made co-extensive. This construction provides a drainage system incorporating passageways 25 and 26 at one end of each barrier section and a similar pair of passageways at the opposite end so that water may be carried therethrough for collection in the duct 22. Electrical conduit or plumbing pipes may be carried in the duct or passageway 23 which is also made continuous with other barrier sections by the indexing and interlocking means.

It is to be understood that although the ducts 22 and 23 are illustrated as having a circular cross section, other geometric configurations such as squares, triangles, hexagons, etc. may also be employed depending upon the shape of equipment or elements to be carried in the ducts as well as the strength requirements of the barrier section.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A barrier comprising:

a barrier having a thickened foot portion buried in ground supporting pavement for a roadway, an upstanding portion projecting above the surface of said pavement, and a tapered intermediate portion integrally interconnecting said foot portion to said upstanding portion;

said foot portion provided with an open-ended duct below said pavement and at least one passageway connecting the surface of said pavement to said duct whereby said duct is in communication exteriorly of said foot portion; and a second open-ended duct provided in said intermediate portion in fixed parallel relationship with respect to said first mentioned duct.

2. The invention as defined in claim 1 including interlocking means comprising a pair of elements outwardly projecting from one end of said barrier and a pair of depressions provided in the other end of said barrier.

3. The invention as defined in claim 2 including guide means comprising tapering each of said elements and conforming said depressions to align and receive said tapered elements.

4. The invention as defined in claim 3 wherein said passageways are open from opposite sides of said barrier and downwardly converge to as to conduct drainage from the surface of said pavement to said first mentioned duct via gravity.

5. The invention as defined in claim 4 including an additional pair of passageways provided at the other end of said barrier.

6. A positive barrier for blocking passage of a vehicle separating lanes on a roadway comprising:

a unitary, integrally constructed barrier having a foot portion buried in a ground supporting pavement for a roadway, a tapered upstanding rail portion projecting above the surface of said pavement, and a tapered intermediate portion integrally interconnecting said foot portion to said upstanding rail portion; and said foot portion provided with an open-ended duct below said pavement extending longitudinally along the length of said barrier having a central axis lying on a central vertical plane of said upstanding portion and at least a pair of transverse passageways opening from opposite sides of said tapered intermediate portion at substantially pavement level and downwardly converging so as to conduct drainage from the surface of said pavement to said duct via gravity and connecting the surface of said pavement to said duct whereby said duct is in communication exteriorly of said foot portion.

7. A barrier section forming a section in combination with a plurality of identical sections to provide a continuous and co-extensive barrier separating lanes on a roadway, the combination comprising:

a barrier section having a thickened foot portion buried in the ground supporting pavement for said roadway, an upstanding portion projecting above the surface of said pavement, and a tapered intermediate portion integrally interconnecting said foot portion to said upstanding portion;

said foot portion provided with an open-ended duct below said pavement and at least a pair of passageways connecting from the surface of said pavement to said duct whereby said duct is in communication exteriorly of said foot portion;

reinforcement means embedded in all of said barrier portions for strengthening said barrier section;

guide and interlocking means carried on opposite ends of said barrier sections for matingly interconnecting the opposing ends of adjacent barrier section so as to provide a co-extensive relationship; and a second open-ended duct provided in said intermediate portion in fixed parallel relationship with respect to said first mentioned duct.

* * * * *